US005758552A

United States Patent [19]

Myers et al.

[11] Patent Number: 5,758,552

[45] Date of Patent: Jun. 2, 1998

[54] TOOL HANDLE SAFETY PLATE

[76] Inventors: Harry T. Myers; Alita Myers, both of 502 Lott Smith Rd. NW, Brookhaven, Miss. 39601

[21] Appl. No.: 762,330

[22] Filed: Dec. 9, 1996

Related U.S. Application Data

[63] Continuation-in-part of Ser. No. 24,835, Jun. 22, 1994, which is a continuation of Ser. No. 830,246, Feb. 5, 1992, abandoned.

[51] Int. Cl.[6] ..... B25D 1/00

[52] U.S. Cl. ..... 81/20; 30/308.1

[58] Field of Search ..... 81/20; 30/308.1

[56] References Cited

U.S. PATENT DOCUMENTS

| | | | |
|---|---|---|---|
| 191,073 | 5/1877 | Roberts | 30/308.1 |
| 210,703 | 12/1878 | Morrill | 30/308.1 |
| 338,193 | 3/1886 | Sawyer | 30/308.1 |
| 374,483 | 12/1887 | Maloney | 30/308.1 |
| 1,582,305 | 4/1926 | Reichling | 81/20 |
| 3,175,232 | 3/1965 | Stowell | 81/20 |
| 4,096,895 | 6/1978 | Fernitz | 81/20 |
| 4,669,342 | 6/1987 | Wilson | 81/20 |
| 4,753,137 | 6/1988 | Kennedy | 81/20 |

FOREIGN PATENT DOCUMENTS

| | | | |
|---|---|---|---|
| 3041531 | 5/1982 | Germany | 81/20 |
| 3307969 | 9/1984 | Germany | 81/20 |
| 501140 | 9/1956 | Italy | 81/20 |

*Primary Examiner*—D. S. Meislin
*Assistant Examiner*—Joni Danganan

[57] ABSTRACT

A safety plate apparatus is used with a tool that includes a handle and a head attached to the handle. The tool head has a handle-receiving channel which has a transverse channel dimension. The tool handle has a channel-inserted handle end which is inserted into the handle-receiving channel. The safety plate apparatus includes a plate member which includes a plate length which is greater than the transverse channel dimension. Screws connect the plate member to the channel-inserted handle end of the handle. The plate member includes at least one fastener-receiving channel, and at least one screw connects the plate member to the channel-inserted handle end of the handle. A portion of each screw is passed through a fastener-receiving channel and driven into the channel-inserted handle end of the handle. The fastener-receiving channel includes a chamfered wall. The plate member can have a plate thickness, and the head can include a top recess which has a recess depth which is approximately equal to the plate thickness. The safety plate apparatus is used to secure a tool head onto a tool handle.

2 Claims, 6 Drawing Sheets

FIG 5
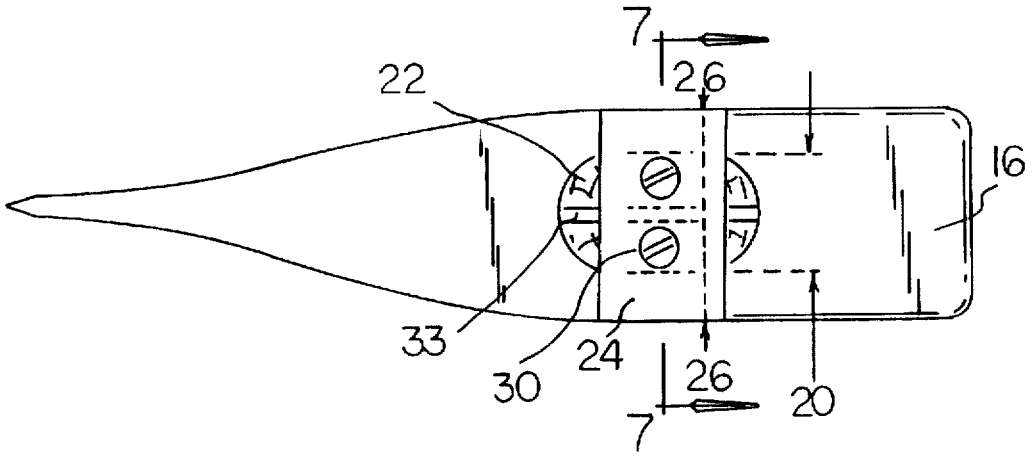
FIG 6
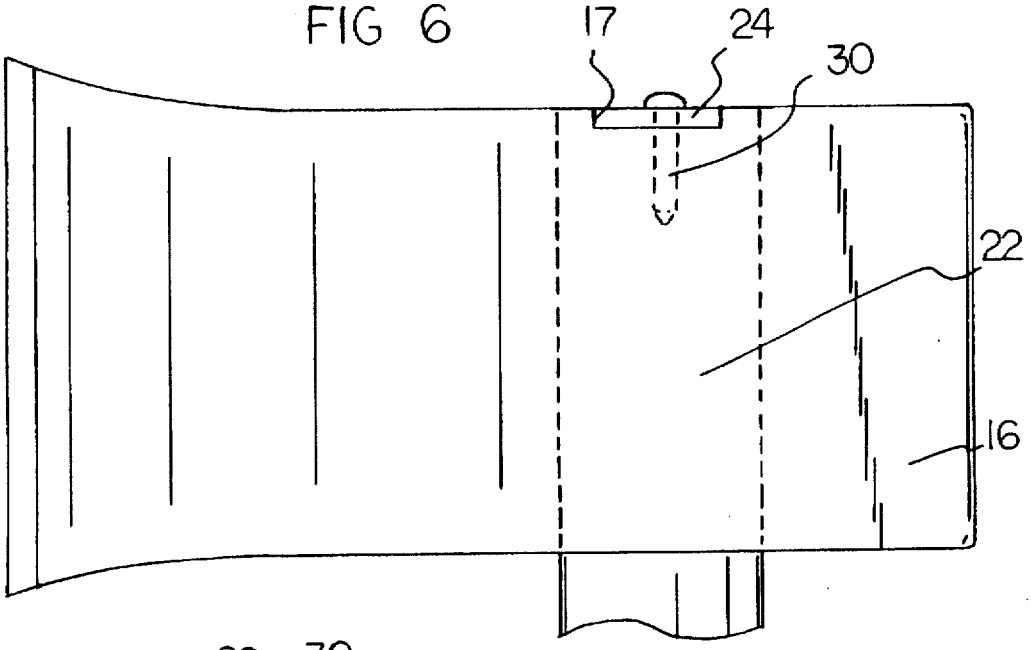
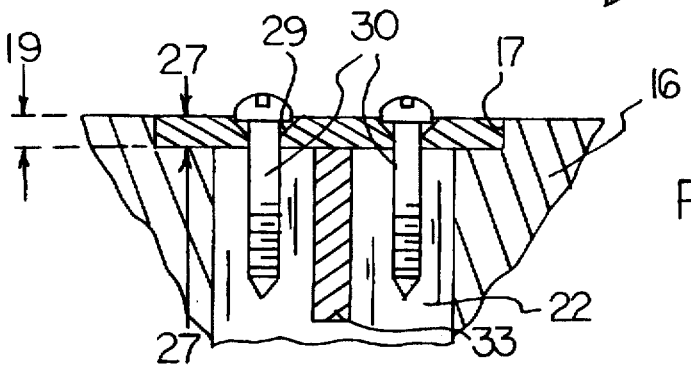
FIG 7

TOOL HANDLE SAFETY PLATE

Related Application

This application is a continuation-in-part of my co-pending prior application Ser. No. 29/024,835, filed Jun. 22, 1994, which in turn, is a continuation of application Ser. No. 07/830,246, filed Feb. 5, 1992, now abandoned.

BACKGROUND OF THE INVENTION

1. Field of the Invention

The present invention relates generally to safety devices for hand tools, and, more particularly, to a safety device especially adapted for preventing a tool head from separating from a tool handle.

2. Description of the Prior Art

Hand tools which have a head attached to a handle are well known and include axes and hammers. When axes, hammers, and the like are used, the handle is grasped and the head is swung in a circular arc. As a result, centrifugal forces tend to pull the head away from the handle. A tool head separating from a tool handle can be a very dangerous occurrence. Such a tool head can injure personnel and can damage property. Moreover, once the head separates from the handle, the tool is rendered useless. In view of such problems, it would be desirable if means were provided for preventing a tool head from separating from a tool handle.

A current way of securing a tool head to a handle involves using a wedge to spread a portion of the handle apart in order for the handle to grip the tool head with greater force. One problem associated with the use of a wedge in this manner is that the process of installing the wedge in the handle may damage the handle. Moreover, the material composing the handle may be deformed by the compressive forces exerted by the wedge. As a result of such deformation, the wedge may lose its effectiveness in exerting an increased gripping force between the tool head and the handle. In view of the above, it would be desirable if means were provided for securing a tool head to a handle without the necessity of employing a wedge driven into the handle.

When a wedge is installed in a handle, the wedge is generally hammered into the handle. The process of hammering may tend to damage the handle. More specifically, if the handle is composed of wood, hammering in a wedge may undesirably crack or split the wood. To avoid hammering a wedge into a tool handle, it would be desirable if a tool handle safety device were provided which can be screwed onto the handle.

When a handle-supported tool head strikes an object, the object often exerts a torque on the tool head around the handle. If the torque is great enough, the tool head may be rotated around the handle. Such an occurrence is also undesirable and dangerous. In this respect, it would be desirable if a device were provided which prevents a tool head from rotating around a tool handle.

Tools are often provided wherein the upper surface of the tool head and the upper surface of the handle are flush. When a tool handle safety device is employed, it would also be desirable if the upper surface of the tool handle safety device and the upper surface of the tool head were flush.

Thus, while the foregoing discussion indicates it to be well known to employ certain techniques to secure a tool head to a handle, it is not known for a tool handle safety device to have the following combination of desirable features: (1) prevents a tool head from separating from a tool handle; (2) secures a tool head to a handle without the necessity of employing a wedge driven into the handle; (3) can be secured to the handle using screws; (4) prevents a tool head from rotating around a tool handle; and (5) provides that the upper surface of the tool handle safety device and the upper surface of the tool head are flush. The foregoing desired characteristics are provided by the unique tool handle safety plate of the present invention as will be made apparent from the following description thereof. Other advantages of the present invention over the prior art also will be rendered evident.

SUMMARY OF THE INVENTION

To achieve the foregoing and other advantages, the present invention, briefly described, provides a safety plate apparatus which is used with a tool that includes a handle and a head attached to the handle. The tool head has a handle-receiving channel which has a transverse channel dimension. The tool handle has a channel-inserted handle end which is inserted into the handle-receiving channel. The safety plate apparatus includes a plate member which includes a plate length which is greater than the transverse channel dimension. Connector means connect the plate member to the channel-inserted handle end of the handle. The plate member includes at least one fastener-receiving channel, and the connector means includes at least one fastener, a portion of which passed through the fastener-receiving channel and driven into the channel-inserted handle end of the handle. The fastener-receiving channel includes a chamfered wall.

In accordance with another aspect of the invention, a combined safety plate and tool apparatus includes a plate member which includes a plate length and a plate thickness and which also includes a tool that has a handle and a head attached to the handle. The head includes a handle-receiving channel which has a transverse channel dimension. The head includes a top recess has a recess depth, and the handle includes a channel-inserted handle end which is inserted into the handle-receiving channel. The plate thickness is approximately equal to the recess depth.

In accordance with yet another aspect of the invention, a method is provided for securing a tool head onto a tool handle. The head has a handle-receiving channel which has a transverse channel dimension, and the handle has a channel-inserted handle end which is inserted into the handle-receiving channel. The tool head securing method includes the steps of obtaining a plate member which has a plate length which is greater than the transverse channel dimension of the handle-receiving channel of the head; placing the plate member on the top of the channel-inserted handle end so that end portions of the plate member cover portions of the tool head; and fastening the plate member to the channel-inserted handle end.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tool handle safety plate which has all of the advantages of the prior art and none of the disadvantages.

It is another object of the present invention to provide a new and improved tool handle safety plate which may be easily and efficiently manufactured and marketed.

It is a further object of the present invention to provide a new and improved tool handle safety plate which is of durable and reliable construction.

An even further object of the present invention is to provide a new and improved tool handle safety plate which is susceptible of a low cost of manufacture with regard to both materials and labor, and which accordingly is then susceptible of low prices of sale to the consuming public, thereby making such tool handle safety plate available to the buying public.

Still yet a further object of the present invention is to provide a new and improved tool handle safety plate which prevents a tool head from separating from a tool handle.

Still another object of the present invention is to provide a new and improved tool handle safety plate that secures a tool head to a handle without the necessity of employing a wedge driven into the handle.

Yet another object of the present invention is to provide a new and improved tool handle safety plate which can be secured to the handle using screws.

Even another object of the present invention is to provide a new and improved tool handle safety plate that prevents a tool head from rotating around a tool handle.

Still a further object of the present invention is to provide a new and improved tool handle safety plate which provides that the upper surface of the tool handle safety device and the upper surface of the tool head are flush.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 5 is a top view of a third embodiment of the tool handle safety plate of the invention installed on an ax that has a top surface having a recess for receiving the tool handle safety plate.

FIG. 6 is a side view of the top portion of the ax and the third embodiment of the invention shown in FIG. 5.

FIG. 7 is a cross-sectional view of the embodiment of the invention shown in FIG. 5 taken along line 7—7 thereof.

DESCRIPTION OF THE PREFERRED EMBODIMENT

With reference to the drawings, a new and improved tool handle safety plate embodying the principles and concepts of the present invention will be described.

Figure 1:
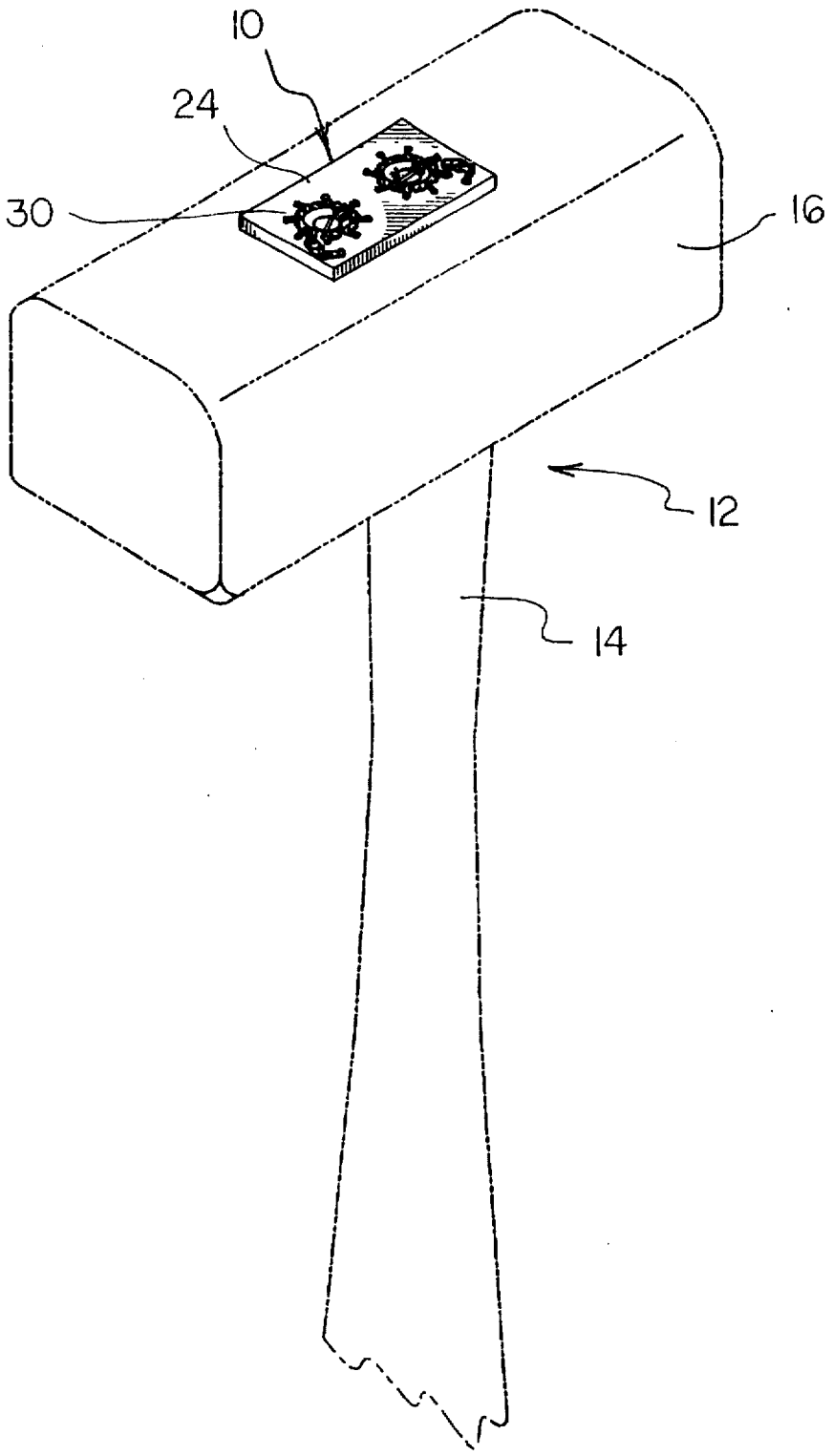
FIG. 1 is a perspective view showing a first embodiment of the tool handle safety plate of the invention installed on a sledge hammer.

Turning to FIG. 1, a first embodiment of the tool handle safety plate of the invention is shown and is generally designated by reference numeral 10. In the first embodiment, the safety plate apparatus 10 is used with a tool 12 that includes a handle 14 and a head 16 attached to the handle 14. The tool head 16 has a handle-receiving channel 18 which has a transverse channel dimension 20. The tool handle 14 has a channel-inserted handle end 22 which is inserted into the handle-receiving channel 18. The safety plate apparatus 10 includes a plate member 24 which includes a plate length 26 which is greater than the transverse channel dimension 20. Connector means connect the plate member 24 to the channel-inserted handle end 22 of the handle 14. If desired, the connector means can be in the form of an adhesive which is used to bond the plate member 24 to the channel-inserted handle end 22 of the tool handle 14.

Alternatively, as shown in the drawings, the plate member 24 includes at least one fastener-receiving channel 28, and the connector means includes at least one fastener 30, a portion of which is passed through the fastener-receiving channel 28 and is driven into the channel-inserted handle end 22 of the handle 14. The fastener-receiving channel 28 includes a chamfered wall 29. When fasteners 30 are employed that have a fastener-head thickness that is less than the depth of the chamfered wall 29 of the fastener-receiving channel 28, then, when the fasteners 30 are employed, the heads of the fasteners 30 can be recessed below the top surface of the plate member 24, such as shown FIG. 1.

Figure 4:
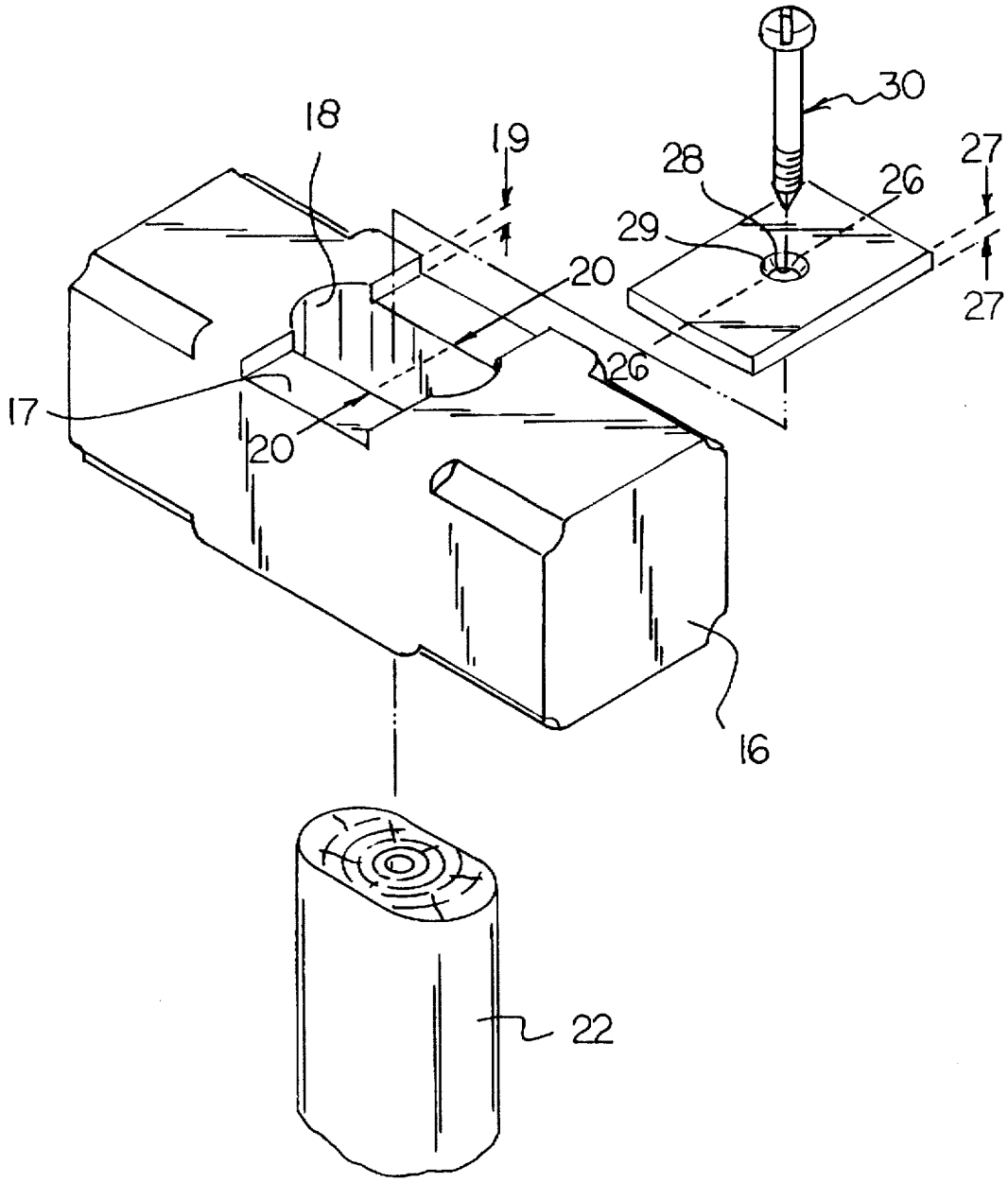
FIG. 4 is an exploded perspective view of the embodiment of the invention shown in FIGS. 2 and 3.

As shown in FIGS. 4 through 7, the fastener 30 includes a head portion and a tip portion (not labeled). When the invention 10 is assembled, the tip portion of the fastener 30 resides entirely within the channel-inserted handle end 22 of the handle 14 such that no portion of the tip portion of the fastener projects beyond an exterior surface of the handle and no portion of the tip portion projects beyond a lower surface of the tool head. As shown in FIGS. 4 and 5, the handle-receiving channel 18 has an interior surface and a longitudinal channel dimension. Preferably, the plate member has longitudinal edges and a plate width, and is sized so that the plate width is substantially less than the longitudinal channel dimension. This structure results in a first gap between the interior surface of the handle receiving channel and a first one of the longitudinal edges, and a second gap between the interior surface of the handle receiving channel and a second one of the longitudinal edges.

In accordance with another aspect of the invention, as shown in FIGS. 2–7, a combined safety plate and tool apparatus includes a plate member 24 which has a plate length 26 and a plate thickness 27 and which also includes a tool 12 that has a handle 14 and a head 16 attached to the handle 14. The head 16 includes a handle-receiving channel 18 which has a transverse channel dimension 20. The head 16 includes a top recess 17 has a recess depth 19, and the handle 14 includes a channel-inserted handle end 22 which is inserted into the handle-receiving channel 18. The plate thickness 27 is approximately equal to the recess depth 19. As a result, when the plate member 24 is located in the top recess 17, the top surface of the plate member 24 and the top surface of the tool head 16 are flush. Also, as shown in FIG. 5, a wedge 33 can be driven into the channel-inserted handle end 22 of the tool handle 14.

Figure 2:
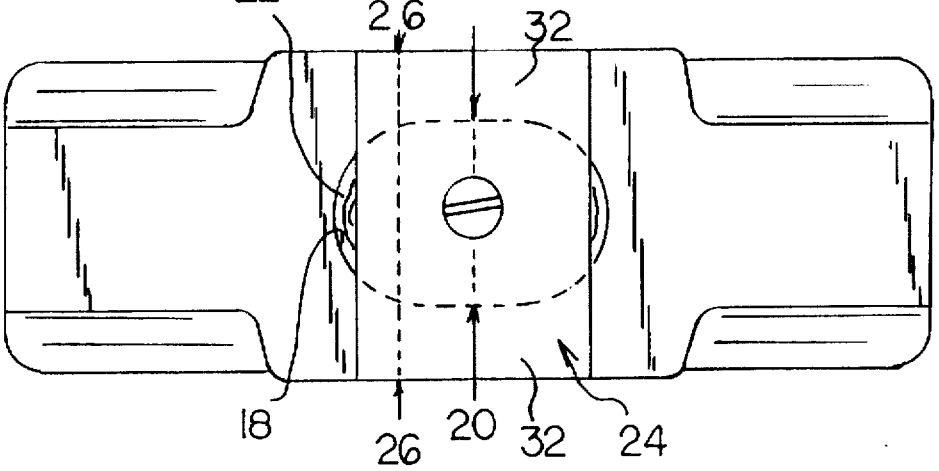
FIG. 2 is a top view of a second embodiment of the tool handle safety plate of the invention installed on a sledge hammer that has an top surface having a recess for receiving the tool handle safety plate.
Figure 3:
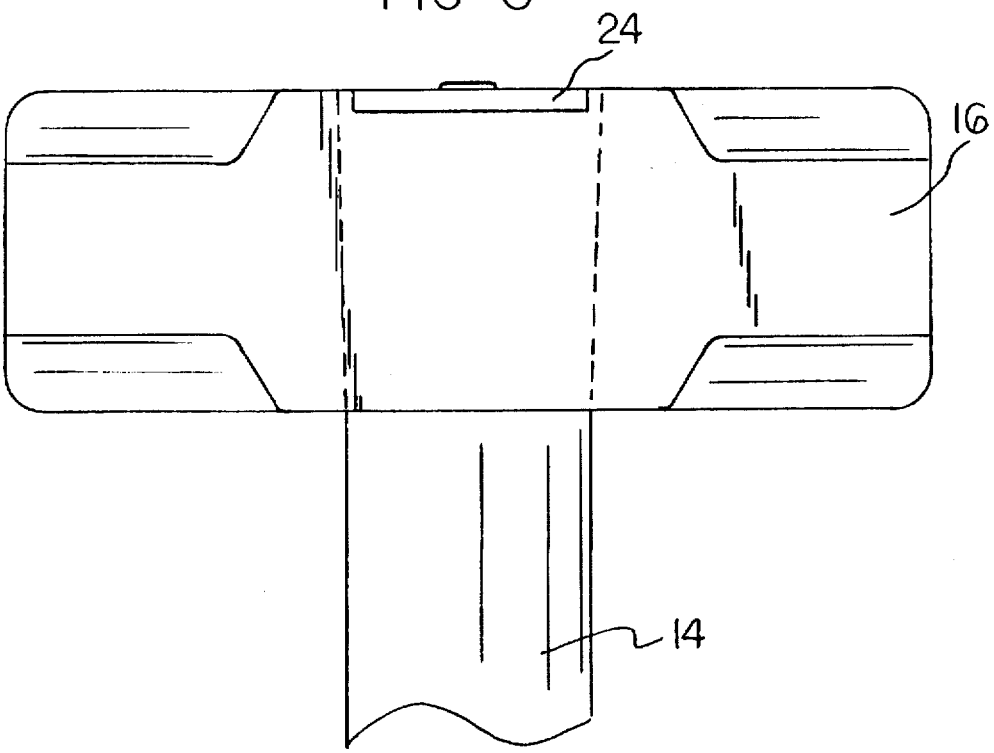
FIG. 3 is a side view of the top portion of the sledge hammer and the second embodiment of the invention shown in FIG. 2.

As shown in FIG. 1, the tool head 16 can be in the form of a sledge hammer which has a smooth top surface. As shown in FIGS. 2–4, the tool head 16 can be in the form of a sledge hammer that has a top recess 17. As shown in FIGS. 5–7, the tool head 16 can be in form of an ax head that has a top recess 17.

In accordance with another aspect of the invention, method is provided for securing a tool head 16 onto a tool handle 14. The head 16 has a handle-receiving channel 18 which has a transverse channel dimension 20, and the handle 14 has a channel-inserted handle end 22 which is inserted into the handle-receiving channel 18. The tool head securing method includes the steps of obtaining a plate member 24 which has a plate length 26 which is greater than the transverse channel dimension 20 of the handle-receiving channel 18 of the head 16; placing the plate member 24 on the top of the channel-inserted handle end 22 so that end portions 32 of the plate member 24 cover portions of the tool head 16; and fastening the plate member 24 to the channel-inserted handle end 22.

As shown in the drawings, the plate member 24 has fastener-receiving channels 28. Screws 30 are obtained, and a portion of each screw 30 is passed through each fastener-receiving channel 28. The screws 30 are driven into the channel-inserted handle end 22 of the handle 14 to secure the plate member 24 to the tool handle 14 and to prevent the tool head 16 from separating from the tool handle 14.

The walls of the top recess 17, in cooperation with edges of the plate member 24, help prevent the tool head 16 from rotating on the tool handle 14. In addition, the employment of plural fasteners 30 driven into the channel-inserted handle end 22 of the tool handle 14 help prevent the tool head 16 from rotating on the tool handle 14.

Figure 8:
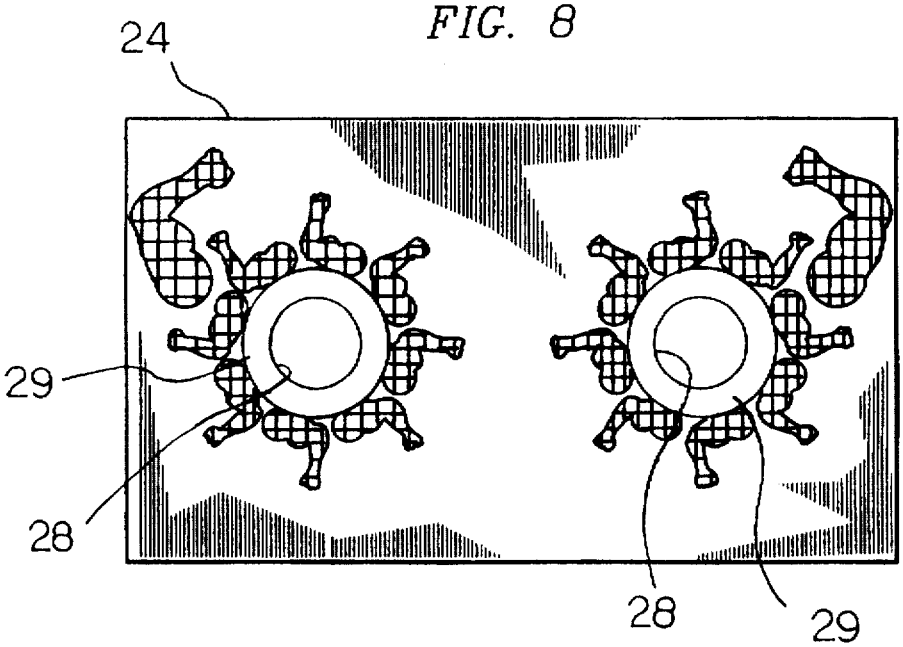
FIG. 8 is an enlarged top view of the embodiment of the invention shown in FIG. 1 removed from the sledge hammer.
Figure 9:
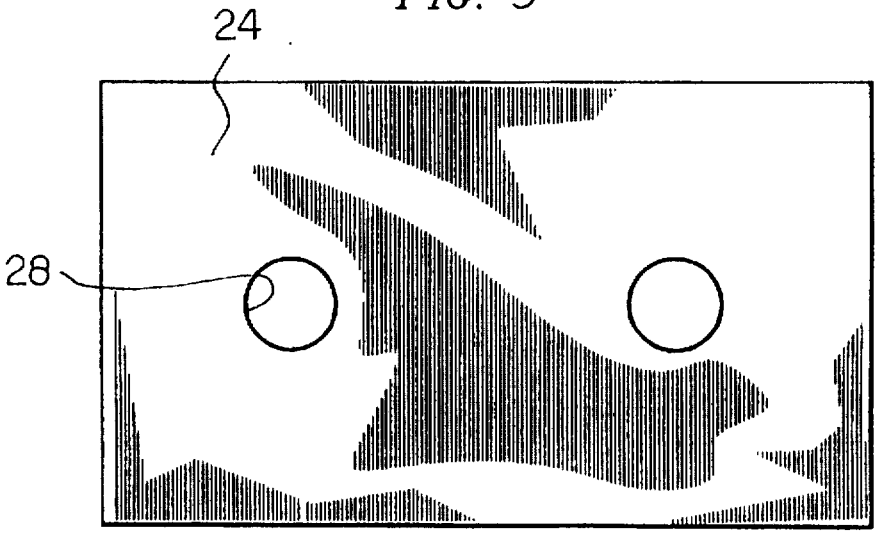
FIG. 9 is a bottom view of the embodiment of the invention shown in FIG. 1.
Figure 10:
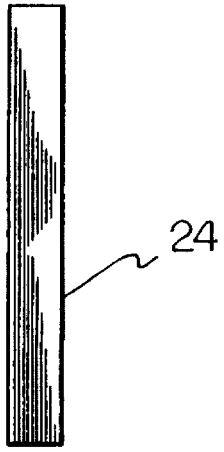
FIG. 10 is a right side view of the embodiment of the invention shown in FIG. 9.
Figure 11:
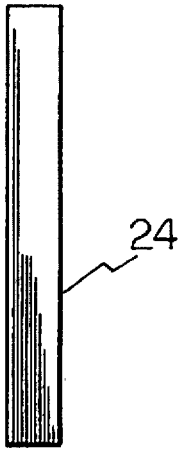
FIG. 11 is a left side view of the embodiment of the invention shown in FIG. 9.
Figure 12:
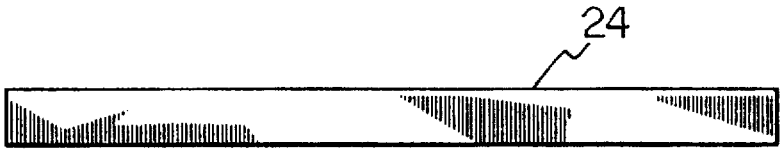
FIG. 12 is a top side view of the embodiment of the invention shown in FIG. 9.
Figure 13:
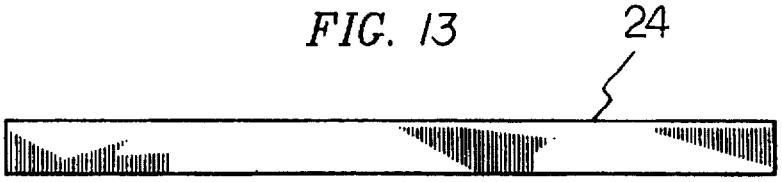
FIG. 13 is a bottom side view of the embodiment of the invention shown in FIG. 9.

As shown in FIGS. 1 and 8, surface indicia in the form of decorative graphic symbols may be placed on the upwardly facing surface of plate member 24. Obviously, any indicia, name, trademark, logo, bar code or the like may be used instead. Alternatively, the upwardly facing surface of the plate member may be left blank (i.e. no surface indicia whatsoever).

The components of the tool handle safety plate of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved tool handle safety plate that is low in cost, relatively simple in design and operation, and which may advantageously be used to prevent a tool head from separating from a tool handle. With the invention, a tool handle safety plate is provided which secures a tool head to a handle without the necessity of employing a wedge driven into the handle. With the invention, a tool handle safety plate is provided which can be secured to the handle using screws. With the invention, a tool handle safety plate is provided which prevents a tool head from rotating around a tool handle. With the invention, a tool handle safety plate provides that the upper surface of the tool handle safety device and the upper surface of the tool head are flush.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A combined safety plate and tool apparatus comprising:

a tool including a handle and a head attached to the handle wherein the head has a handle-receiving channel which has a transverse channel dimension, and wherein the handle has channel-inserted handle end which is inserted into the handle receiving-channel;

a plate member which includes a plate length which is greater than the transverse channel dimension, said plate member including a fastener-receiving channel;

connector means for connecting said plate member to the channel-inserted handle end of the handle, the connector means including a fastener, a portion of which extends through said fastener-receiving channel and into the channel-inserted handle end of the handle, wherein the fastener includes a head portion and a tip portion, wherein the tip portion of the fastener resides entirely within the channel-inserted handle end of the handle such that no portion of the tip portion of the fastener projects beyond a lower surface of the tool heads;

wherein the handle-receiving channel has an interior surface and a longitudinal channel dimension, wherein the plate member includes longitudinal edges and a plate width, said plate width being substantially less than the longitudinal channel dimension so as to define a first gap between the interior surface of the handle receiving channel and a first one of the longitudinal edges, and a second gap between the interior surface of the handle receiving channel and a second one of the longitudinal edges.

2. A combined safety plate and tool apparatus comprising:

a plate member which includes a plate length and a plate thickness, said plate member including a first fastener-receiving channel and a second fastener-receiving channel;

a tool that includes a handle and a head attached to the handle, wherein said head includes a handle-receiving channel which has a transverse channel dimension, wherein said head includes a top recess having a recess depth, and wherein said handle includes a channel-inserted handle end which is inserted into the handle-receiving channel;

a wedge driven into the channel-inserted handle end of the handle;

a first fastener extending through said first fastener-receiving channel and into the channel-inserted handle end of the handle on a first side of the wedge, and a second fastener extending through said second fastener-receiving channel and into the channel-inserted handle end of the handle on a second side of the wedge;

wherein the fasteners each include a head portion and a tip portion, wherein the tip portions of the fasteners reside entirely within the channel-inserted handle end of the handle such that no portion of the tip portions of the fasteners projects beyond an exterior surface of the handle and no portion of the tip portions of the fasteners projects beyond a lower surface of the tool head;

wherein the handle-receiving channel has an interior surface and a longitudinal channel dimension, wherein the plate member includes longitudinal edges and a plate width, said plate width being substantially less than the longitudinal channel dimension so as to define a first gap between the interior surface of the handle-receiving channel and a first one of the longitudinal edges, and a second gap between the interior surface of the handle-receiving channel and a second one of the longitudinal edges.

* * * * *